United States Patent [19]

Ogawa et al.

[11] Patent Number: 4,826,086

[45] Date of Patent: May 2, 1989

[54] FUEL INJECTION VALVE

[75] Inventors: Masanobu Ogawa; Iwao Ohno, both of Higashimatsuyama, Japan

[73] Assignee: Diesel Kiki Co., Ltd., Tokyo, Japan

[21] Appl. No.: 182,849

[22] Filed: Apr. 18, 1988

[30] Foreign Application Priority Data

Apr. 21, 1987 [JP] Japan ..... 62-061082[U]

[51] Int. Cl.[4] ..... F02M 45/08

[52] U.S. Cl. ..... 239/533.5; 73/119 A; 239/533.9

[58] Field of Search ..... 73/119 A; 239/533.3, 239/533.4, 533.5, 533.9

[56] References Cited

U.S. PATENT DOCUMENTS 4,390,129 6/1983 Uchida ..... 239/533.5
4,448,356 5/1984 Nakajima et al. ..... 239/533.5

FOREIGN PATENT DOCUMENTS 59-46364 3/1984 Japan .

*Primary Examiner*—Jerry W. Myracle
*Attorney, Agent, or Firm*—Frishauf, Holtz, Goodman & Woodward

[57] ABSTRACT

A fuel injection valve for use in an internal combustion engine includes a nozzle having a nozzle needle, a nozzle holder supporting the nozzle, first and second springs provided in the nozzle holder and determining valve opening pressures for initial injection and main injection, respectively, a first movable spring seat supported by the nozzle needle and supporting the first spring, and a second movable spring seat having a rod mounted thereon and supporting the second spring, the rod being disposed in spaced and opposed relation to the first movable spring seat. In the nozzle holder are formed first and second spring chambers with the first and second springs fitted therein, respectively. A stepped portion is provided between the first and second spring chambers. The nozzle holder has a reference surface at its end portion remote from the nozzle, with respect to which various portions of the injection valve are measured. A set screw is threadedly fitted in a tapped bore formed therein and having a contact surface disposed in contact with the reference surface. A first shim is interposed between the first spring and an end face of the stepped portion and determines the setting force of the first spring, a second shim between the other end face of the stepped portion and the second movable spring seat and determines the lifting amount of the nozzle needle during the initial injection, and a third shim between the second spring and an end face of the set screw and determines the setting force of the second spring.

9 Claims, 1 Drawing Sheet

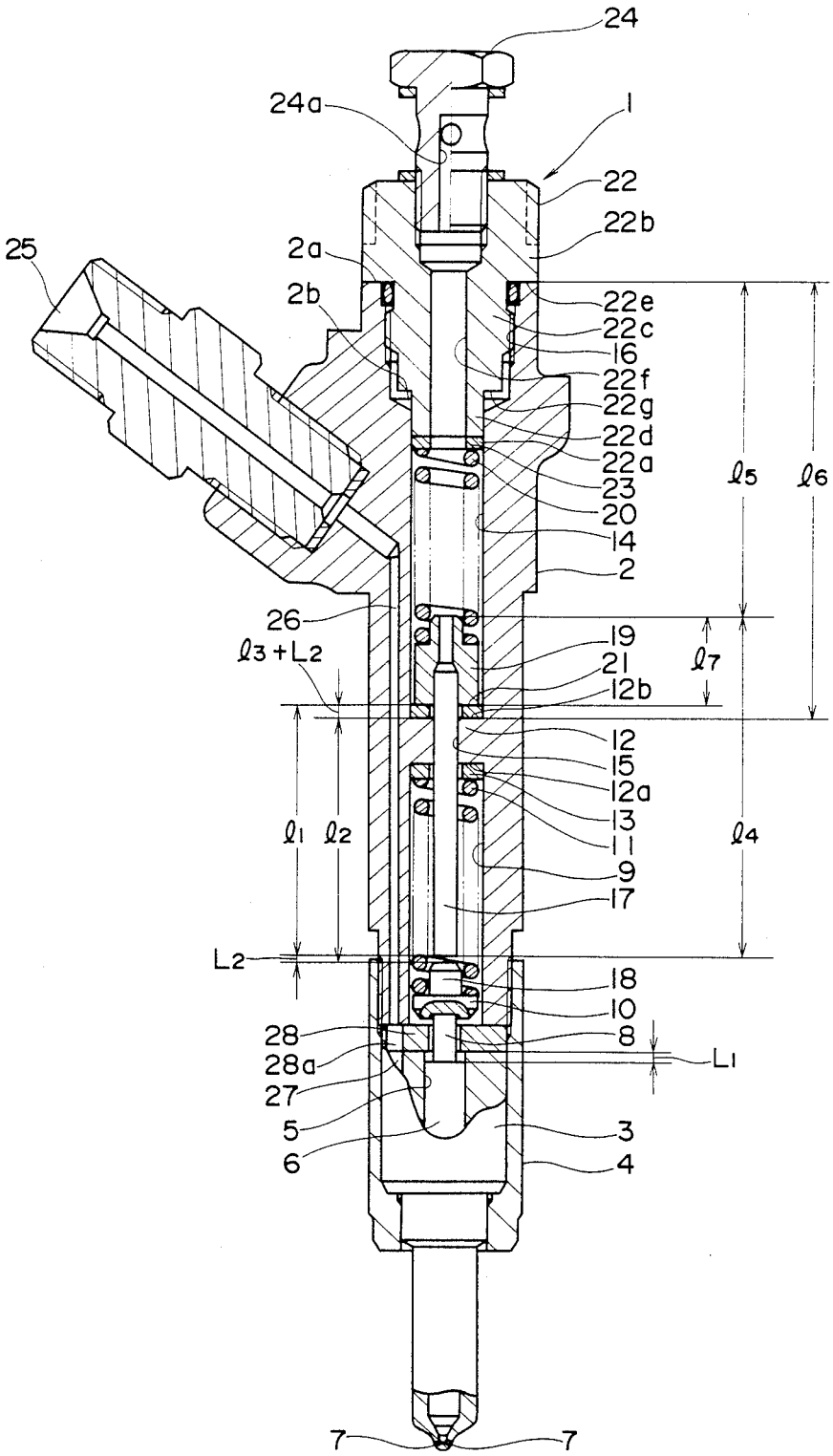
24
24a
1
22
22b
25
2a
2b
22e
22c
16
22f
22g
22d
22a
23
20
14
2
ℓ5
ℓ6
26
19
21
12b
ℓ3+L2
ℓ7
12
15
12a
13
11
9
17
ℓ1
ℓ2
ℓ4
L2
18
10
28
8
28a
L1
27
5
6
3
4
7
7

FUEL INJECTION VALVE

BACKGROUND OF THE INVENTION

The present invention relates to a fuel injection valve for use in internal combustion engines, especially diesel engines.

It is required in diesel engines in general to set the fuel injection rate, that is, a fuel amount to be injected per unit time, at high values so as to obtain satisfactory output characteristics of the engine and reduce noxious components such as nitrogen oxides in the exhaust gases. However, an increase in the fuel injection rate is accompanied by a corresponding decrease in the fuel injection period of time, which causes sudden combustion of fuel within combustion chambers, causing combustion noise as well as an excessive increase in the pressure within cylinders.

Conventional fuel injection valves of this kind have the problem that the nozzle needle lifts at the same increasing rate in a small injection quantity region as in a large injection quantity region, which causes unstable injection, i.e. so-called irregular injection. That is, in the small injection quantity region the lifting amount becomes excessive in one cycle of injection to thereby cause an excessive injection quantity, which is followed by an excessive decrease in the fuel injection quantity in the next cycle due to a reduction in the pressure within the injection pipe connecting the fuel injection valve to a fuel injection pump, and then the injection quantity becomes again excessive in the following cycle.

To overcome this disadvantage, a fuel injection valve has been proposed, e.g. by Japanese Provisional Patent Publication (Kokai) No. 59-46364, in which a first spring acting at the initial stage of injection and a second spring acting at the following main injection are provided in a nozzle holder, wherein an initial injection stroke is effected under a valve-opening pressure determined by the force of the first spring, while a main injection stroke subsequent to the initial injection stroke is effected under a valve-opening pressure determined by the sum of the forces of the first and second springs, whereby the fuel injection rate is reduced throughout the whole injection stroke, to thereby prevent generation of combustion noise and reduce noxious components in the exhaust gases, as well as prevent irregular injection.

The proposed fuel injection valve is constructed such that a nozzle needle is arranged within a nozzle mounted on an end of a nozzle holder and abuts against a first movable spring seat, and the first spring is interposed between the first movable spring seat and a first stationary spring seat and determines the valve opening pressure of the nozzle needle during the initial injection stroke. Further, a rod having a second movable spring seat mounted thereon is disposed within the nozzle holder, with its end face facing the nozzle movable in spaced and opposed relative to the first movable spring seat, with a gap corresponding to the initial injection life of the nozzle needle therebetween. A second spring is interposed between the second movable spring seat and a second stationary spring seat, and determines the valve opening pressure of the nozzle needle during the main injection stroke.

The proposed fuel injection valve uses five component parts to separately adjust the setting forces of the first and second springs with ease, namely, a supporting member for the second movable spring seat, an externally threaded member for supporting an end of the second spring seated thereon, a screw for adjusting the setting force of the second spring, a lock nut for fixing the adjusting screw in position, and a cap nut for covering the externally threaded member. Thus, numerous component parts are required, which causes an increase in the number of steps of assembly, resulting in an increase in cost. Further, the supporting member for the second movable spring seat is cylindrically shaped, with a whole body thereof fitted in the nozzle holder, the externally threaded member being also cylindrically shaped, with a portion thereof threadedly fitted in a tapped bore formed in an end portion of the nozzle holder remote from the nozzle, the cap nut being also cylindrically shaped and threadedly mounted on the outer peripheral surface of the externally threaded member. Thus, many component parts are coaxially fitted on the nozzle holder, so that the fuel injection valve is large in radial size as a whole, as well as large in weight.

SUMMARY OF THE INVENTION

It is the object of the invention to provide a fuel injection valve, in which the lifting amount of the nozzle needle during the initial injection stroke and the respective setting forces of the first and second springs can be separately adjusted with ease, and at the same time reduction in the number of component parts, cost, size, and weight is achieved.

The invention provides a fuel injection valve for use in an internal combustion engine, the fuel injection valve being of the type effecting initial injection and main injection and including a nozzle holder, a nozzle supported by the nozzle holder and having a nozzle needle slidably fitted therein, a first movable spring seat supported by the nozzle needle, a first stationary spring seat disposed at a side of the first movable spring seat remote from the nozzle, a first spring interposed between the first movable spring seat and the first stationary spring seat and determining a valve opening pressure for the initial injection, a second movable spring seat disposed at a side of the first stationary spring seat remote from the nozzle and having a rod member extending therefrom toward the nozzle and disposed in spaced and opposed relation to the first movable spring seat, a second stationary spring seat disposed at a side of the second movable spring seat remote from the nozzle, and a second spring interposed between the second movable spring seat and the second stationary spring seat and determining a valve opening pressure for the main injection.

The fuel injection valve according to the invention is characterized by the improvement comprising: a first spring chamber in which the first spring is fitted, a stepped portion having an end face facing toward the nozzle and serving as the first stationary spring seat, a second spring chamber in which the second spring is fitted, a threaded bore, the first spring chamber, the stepped portion, the second spring chamber, and the threaded bore being formed in the nozzle holder and consecutively arranged in the mentioned order, the nozzle holder having a reference surface at an end portion thereof remote from the nozzle, a set screw threadedly fitted in the threaded bore, the set screw having a contact surface disposed in contact with the reference surface, the set screw having an end face facing toward the nozzle and serving as the second stationary spring seat, a first shim interposed between the first spring and the end face of the stepped portion and determining the setting force of the first spring, a second shim interposed between another end face of the stepped portion remote from the nozzle and the second movable spring seat and determining a lifting amount through which the nozzle needle lifts for the initial injection, and a third shim interposed between the second spring and the end face of the set screw and determining the setting force of the second spring, the reference surface being used for measurement of distances between the reference surface and portions of the fuel injection valve in order to determine at least a desired sum of the setting forces of the first and second springs and a desired lifting amount through which the nozzle needle lifts for the initial injection.

The above and other objects, features and advantages of the invention will be more apparent from the ensuring detailed description taken in conjunction with the accompanying drawing.

BRIEF DESCRIPTION OF THE DRAWING

The single figure shows a longitudinal cross-sectional view of a fuel injection valve according to an embodiment of the invention.

DETAILED DESCRIPTION

The invention will now be described in detail with reference to the drawing showing an embodiment thereof. In the figure, reference numeral 1 designates a fuel injection valve. Numeral 2 designates a nozzle holder of the fuel injection valve 1, with an end surface 2a thereof serving as a reference surface, with respect to which various portions of the injection valve are measured, as hereinafter described. A nozzle 3 is fastened to an end of the nozzle holder 2 by means of a retaining nut 4 threadedly fitted thereon, via a distance piece 28. The nozzle 3 has a bore 5 formed therethrough, in which a nozzle needle 6 is slidably fitted. The nozzle needle 6 has a seating end thereof normally disposed in contact with a seating surface formed inside the nozzle 3, whereby nozzle holes 7 formed in th tip of the nozzle 3 are closed and opened, respectively. The nozzle needle 6 is lifted by pressure within a pressure chamber, not shown, formed in the nozzle 3. When the nozzle needle 6 assumes a seated position as shown in the figure, the nozzle holes 7 are closed, wherein a whole lifting gap $L_1$, through which the nozzle needle 6 lifts for main injection, is provided between an end face of the nozzle needle 6 and an opposed end face of the distance piece 28. A journal 8 is provided integrally on the end of the nozzle needle 6 remote from the nozzle holes 7 and projects into a first spring chamber 9 defined in the nozzle holder 2 and extending from an end of the nozzle holder 2 to an axially intermediate portion of same. Mounted on an end of the journal 8 projected into the first spring chamber 9 is a first movable spring seat 10, which supports an end of a first coiled spring 11 fitted within the first spring chamber 9. An opposite end of the first spring 11 is supported by an end face 12a of a stepped portion 12 integral with the nozzle holder 2 via a shim 13. The nozzle needle 6 is urged in a direction of closing the nozzle holes 7 by the force of the first spring 11. The stepped portion 12 is located between the first spring chamber 9 and a second spring chamber 14 defined in the nozzle holder 2 in coaxial relation to the first spring chamber 9, in a manner defining end faces of the two chambers 9 and 14. The stepped portion 12 has a central through bore 15 formed therethrough and having a smaller diameter than that of the first spring chamber 9. The second spring chamber 14 has substantially the same diameter as that of the first spring chamber 9. A tapped bore 16 as a threaded hole is formed in the nozzle holder 2, with a larger diameter than that of the second spring chamber 14, and axially extends from an end of the second spring chamber 14 remote from the first spring chamber 9 to the end face 2a of the nozzle holder 2. A rod 17 is axially movably disposed within the first spring chamber 9, and extends through the through bore 15, and into the second spring chamber 14. When the rod 17 assumes an extreme position toward the nozzle needle 6, an initial lifting gap $L_2$, through which the nozzle needle 6 lifts for initial injection, is provided between an end face of the rod 17 facing toward the nozzle 3 and an opposed end face of a short pin 18 secured on an upper end face of the first movable spring seat 10. A second movable spring seat 19 is fixedly mounted on the end portion of the rod 17 projected into the second spring chamber 14, and supports an end of a second coiled spring 20 fitted in the second spring chamber 14. A shim 21 is interposed between an end face of the second movable spring seat 19 facing toward the nozzle 3 and an opposed end face 12b of the stepped portion 12. An opposed end of the second spring 20 is supported via a shim 23 by an end face (a second stationary spring seat) *22a* of a set screw 22 which is formed by a one-piece member. The set screw 22 has an enlarged-diameter portion *22b*, an intermediate-diameter portion *22c*, and a reduced-diameter portion *22d*, arranged in the mentioned order from an end remote from the nozzle needle 6 to an opposite end thereof. An external thread is formed on an outer peripheral surface of the intermediate-diameter portion *22c*, which is threadedly fitted in an internal thread formed on an inner peripheral surface of the tapped hole 16, with the reduced-diameter portion *22d* fitted in an opening of the second spring chamber 14 in the end face of the nozzle holder. When the set screw 22 is fully screwed into the tapped bore 16, a radial surface *22e* of the set screw 2 at the border between the enlarged-diameter portion *22b* and the intermediate-diameter portion *22c* is brought into contact with the end face *2a* of the nozzle holder 2. An oil drain passage *22f* is axially formed through the set screw 22, which is communicated with a fuel oil drain passage *24a* formed in a plug 24 threadedly fitted in an opening of the set screw 22, and opens into the second spring chamber 14. The nozzle holder 2 is provided at one side thereof with a fuel inlet port 25 communicated with the pressure chamber in the nozzle 3 via a fuel intake passage 26 formed in the nozzle holder 2, a fuel intake passage *28a* formed in the distance piece 28, and a fuel intake passage 27 formed in the nozzle 3.

The operation of the fuel injection valve constructed as above according to the invention will now be described.

Pressurized fuel supplied from a fuel injection pump, now shown, is introduced into the pressure chamber through the inlet port 25, the fuel intake passages 26, *28a*, and 27. As the pressurized fuel is introduce into the pressure chamber, the pressure of fuel within the pressure chamber is increased to act upon a pressure stage, not shown, of the nozzle needle 6. When the increased pressure within the pressure chamber overcomes the urging force of the first spring 11, that is, rises to an initial valve opening pressure, the nozzle needle 6 is lifted through the initial lifting gap $L_2$ against the urging force of the first spring 11, so that the seating portion of the nozzle needle 6 moves away from the seating portion of the nozzle 3, thereby effecting the initial injection of fuel through the nozzle holes 7 at a low injection rate. When the nozzle needle 6 has lifted through the gap $L_2$, the end face of the pin 18 on the first movable spring seat 10 is brought into contact with the opposed end face of the rod 17 supporting the second movable spring seat 19. As the fuel pressure is further increased to exceed the sum of the urging forces of the first spring 11 and the second spring 20, the nozzle needle 6 further lifts to complete the whole injection lift corresponding to the whole lifting gap L1 while pushing the second movable spring seat 19, via the first movable spring seat 10, the pin 18, and the rod 17, away from the nozzle 3 to effect main injection at a high injection rate.

A manner of adjusting the setting forces of the first and second springs 11, 20, and the initial lifting gap $L_2$ will now be described.

First, the setting force of the first spring 11 is adjusted. The setting force of the first spring 11 is measured with the shim 13 removed from the nozzle holder 2. Then, a shim 13, which has such a thickness as to impart a desired setting force to the first spring 11 is inserted into the first spring chamber 9 through an end opening thereof facing toward the nozzle 3 and placed at the end face 12*a* of the stepped portion 12. Then, the first spring 11 is inserted into the first spring chamber 9 from the same end opening thereof, followed by inserting the first movable spring seat 10 into the chamber 9 in a manner supporting the associated end of the first spring 11. The nozzle 3 is then brought into face-to-face contact with the nozzle holder 2 and fastened thereto by means of the retaining nut 4. Thus, the adjustment of the setting force of the first spring 11 is completed.

Next, the sum of the setting forces of the first and second springs 11 and 20 is adjusted. In making this adjustment, measurements are first made of a distance (length) $l_6$ between the end face 2*a* of the nozzle holder 2 and the end face 12*b* of the stepped portion 12 on which the shim 21 is placed, a distance $l_4$ between an end face of the second movable spring seat 19 remote from the nozzle 3 and an end face of the rod 17 facing toward the nozzle 3, and a distance $l_7$ facing toward the nozzle 3 between the opposite end faces of the second movable spring seat 19. It is so designed that a distance $l_2$ between the end face 12b of the stepped portion 12 and the end face of the pin 18 on the first movable spring seat 10 facing toward the rod 17 is smaller than the difference $l_1$ between the distances $l_4$ and $l_7$ ($l_1 = l_4 - l_7$), that is, $l_1 > l_2$.

Then, the rod 17 and the second movable spring seat 19 fitted thereon are inserted into the first spring chamber 9 through the end opening of the nozzle holder 2 remote from the nozzle 3 via the tapped bore 16, the second spring chamber 14, and the through bore 15 in the stepped portion 12, until the end face of the rod 17 facing toward the nozzle 3 abuts against the opposed end face of the pin 18 on the first movable spring seat 10. In this state, a distance $l_5$ is measured between the end face 2*a* of the nozzle holder 2 and the end face of the second movable spring seat 19 remote from the nozzle 3. A distance $l_3$ between the end face of the second spring seat 19 facing toward the nozzle 3 and the end face 12*b* of the stepped portion 12 remote from the nozzle 3 is obtained by subtracting the distances $l_5$ and $l_7$ from $l_6$, that is, $l_3 = l_6 - l_5 - l_7$. Consequently, the thickness of the shim 21 should be $l_3 + L_2$.

Then, a shim 23 is placed onto the end face of the second spring 20 remote from the nozzle 3, which has such a thickness as is considered to provide the second spring 20 with a desired setting force. Subsequently, the set screw 22 is screwed into the tapped bore 16 in the nozzle holder 2, until the radial surface 22*e* of the set screw 22 abuts against the end face 2*a* of the nozzle holder 2. In this state, the sum of the setting forces of the first and second springs 11 and 20 is measured to determine whether or not the desired setting force is obtained. If the desired setting force is not obtained, the shim 23 is removed from the nozzle holder 2 together with the set screw 22. Instead, another shim 23 having a different thickness which is considered to provide the desired setting force is placed onto the end face of the second spring 20, and then the set screw 22 is again screwed into the tapped bore 16 in the nozzle holder 2, until the radial surface 22*e* abuts against the end face 2*a* of the nozzle holder 2, followed by again measuring the sum of the setting forces of the springs 11 and 20. The thickness of the shim 23 providing the desired setting force is represented by $l_8$. After finishing the adjustment of the setting forces of the springs 11 and 20, the set screw 22, the shim 23, the second spring 20, and the rod 17 with the second movable spring seat 19 are removed from the nozzle holder 2.

Subsequently, the shim 21 having the desired thickness (=the initial lifting gap $L_2$+the $l_3$, the L2 being a predetermined value) is placed onto the end face 12*b* of the stepped portion 12, and then the rod 17 with the second movable spring seat 19, the second spring 20, and the shim 23 having a thickness which is obtained by subtracting the initial lifting gap $L_2$ from the desired thickness $l_8$, are inserted into the nozzle holder 2 in the mentioned order. Then the set screw 22 is screwed into the tapped bore 16 in the nozzle holder 2, until the radial surface 22*e* abuts against the end face 2*a* of the nozzle holder 2, whereby the initial lifting gap $L_2$ is set between the end face of the rod 17 facing toward the nozzle 3 and the opposed end face of the pin 18 on the first movable spring seat 10.

As described above, after the adjustment of the setting forces of the first and second springs 11 and 20, in order to set the initial lifting gap $L_2$, the set screw 22, the shim 23, the second spring 20, and the rod 17 with the second movable spring seat 19 are removed from the nozzle holder 2. According to the invention, the sizes of the various portions are measured with reference to the end face 2*a* of the nozzle holder 2 as the reference surface. Therefore, once the respective thicknesses of the shim 13, the shim 21 ($L_2 + l_3$), and the shim 23 ($l_8 - L_2$) have been determined, even if the set screw 22 is removed from the nozzle holder 2, the setting forces of the springs 11, 20 and the initial lifting gap $L_2$ are automatically set to the respective adjusted values, when the set screw 22 is again screwed into the tapped bore 16 until the radial surface 22*e* of the set screw 22 abuts against the end face 2*a* of the nozzle holder 2. Therefore, no readjustment of the setting forces of the springs 11 and 20 is needed.

Although in the above-described embodiment the end face 2*a* of the nozzle holder 2 remote from the nozzle 3 is used as the reference surface, the reference surface should not be limited to the surface 2a, but may be a surface of a stepped shoulder 2b between the tapped bore 16 in the nozzle holder 2 and the second spring chamber 14. In the latter case, a contact surface to be brought into contact with the stepped portion 2*b* should be a stepped portion 22g of the set screw 2 opposed to the stepped portion 2b, and further the nozzle holder 2 and/or the set screw 22 should be so designed that the end face 2*a* of the nozzle holder 2 is not brought into contact with the radial surface 22*e* of the set screw 22 when the set screw 22 is fully screwed into the bore 16.

Further, in the embodiment, the stepped portion 12 is formed as an integral part of the nozzle holder 2 by boring the first and second spring chambers 9 and 14 in a manner being separated from each other with an intermediate portion being the stepped portion 12. However, this is not limitative to the invention, but the stepped portion 12 may be formed by a separate ring member which is fitted into an intermediate portion fo a continuous through bore formed through the nozzle holder 2 such that the first and second chambers 9 and 14 are defined at opposite sides of the ring member 2.

Furthermore, although the plug 24 is threadedly fitted in the set screw 22 in the above described embodiment, a hose coupling for draining leakage fuel may be mounted on the set screw 22, instead.

As described above, according to the fuel injection valve of the invention, the contact surface of the set screw abuts against the reference surface of the nozzle holder when the set screw is fully screwed into the tapped bore. Therefore, once the setting forces of the springs have been adjusted, with the contact surface of the set screw in contact with the reference surface of the nozzle holder, even if the set screw is removed from the nozzle holder, the setting forces of the springs are automatically set to the adjusted values when the set screw is again screwed into the bore, thereby requiring no more adjustment.

Further, the stepped portion integral with the nozzle holder between the first and second spring chambers can dispense with the use of a separate supporting member for the second movable spring seat. Also, since the set screw singly has all the functions of the conventional four component parts, i.e. the externally threaded member, the screw for adjusting the setting forces of the springs, the lock nut, and the cap nut, it is unnecessary to provide the component parts separately. Therefore, according to the invention, the initial lifting amount of the nozzle needle during the initial injection and the respective setting forces of the first and second springs can be separately adjusted with ease, and at the same time reduction in the number of component parts, cost, size, and weight can be achieved.

What is claimed is:

1. In a fuel injection valve for use in an internal combustion engine, said fuel injection valve being of the type effecting initial injection and main injection and including a nozzle holder, a nozzle supported by said nozzle holder and having a nozzle needle slidably fitted therein, a first movable spring seat supported by said nozzle needle, a first stationary spring seat disposed at a side of said first movable spring seat remote from said nozzle, a first spring interposed between said first movable spring seat and said first stationary spring seat and determining a valve opening pressure for said initial injection, a second movable spring seat disposed at a side of said first stationary spring seat remote from said nozzle and having a rod member extending therefrom toward said nozzle and disposed in spaced and opposed relation to said first movable spring seat, a second stationary spring seat disposed at a side of said second movable spring seat remote from said nozzle, and a second spring interposed between said second movable spring seat and said second stationary spring seat and determining a valve opening pressure for said main injection, the improvement comprising a first spring chamber in which said first spring is fitted, a stepped portion having an end face facing toward said nozzle and serving as said first stationary spring seat, a second spring chamber in which said second spring is fitted, a threaded hole, said first spring chamber, said stepped portion, said second spring chamber, and said threaded hole being formed in said nozzle holder and consecutively arranged in the mentioned order, said nozzle holder having a reference surface at an end portion thereof remote from said nozzle, a set screw threadedly fitted in said threaded hole, said set screw having a contact surface disposed in contact with said reference surface, said set screw having an end face facing toward said nozzle and serving as said second stationary spring seat, a first shim interposed between said first spring and said end face of said stepped portion and determining the setting force of said first spring, a second shim interposed between another end face of said stepped portion remote from said nozzle and said second movable spring seat and determining a lifting amount through which said nozzle needle lifts for said initial injection, and a third shim interposed between said second spring and said end face of said set screw and determining the setting force of said second spring, said reference surface being used for measurement of distances between said reference surface and portions of said fuel injection valve in order to determine at least a desired sum of the setting forces of said first and second springs and a desired lifting amount through which said nozzle needle lifts for said initial injection.

2. A fuel injection valve as claimed in claim 1, wherein said reference surface of said nozzle holder is an end face of said nozzle holder remote from said nozzle.

3. A fuel injection valve as claimed in claim 2 wherein said contact surface of said set screw is a surface on a stepped portion of said set screw.

4. A fuel injection valve as claimed in claim 1, wherein said reference surface of said nozzle holder is a surface of a stepped shoulder of said nozzle holder between said second spring chamber and said threaded hole.

5. A fuel injection valve as claimed in claim 4, wherein said contact surface of said set screw is a surface on a stepped portion of said set screw.

6. A fuel injection valve as claimed in claim 1, wherein said set screw is formed by a one-piece member.

7. A fuel injection valve as claimed in claim 1, wherein said stepped portion is formed integrally with said nozzle holder.

8. A fuel injection valve as claimed in claim 1, wherein said second shim has a thickness thereof set at:

$$l_3+L_2,\ l_3 \text{ being equal to } l_6-l_5-l_7,$$

where:

$l_6$ = the distance between the reference surface of the nozzle holder and the another end face of the stepped portion;

$l_5$ = the distance between the reference surface and an end face of the second movable spring seat remote from the nozzle, assumed when the rod member of the second movable spring seat is in contact with the first movable spring seat with the second shim removed from the nozzle holder;

$l_7$ = the distance between the opposite end faces of the second movable spring seat; and $L_2$ = the desired lifting amount through which the nozzle needle lifts for the initial injection.

9. A fuel injection valve as claimed in claim 1, wherein said third shim has a thickness set at:

$$l_8 - L_2,$$

where:

$l_8$ = at thickness which provides a desired sum of the setting forces of said first and second springs, measured when the second shim is not interposed between the second movable spring seat and the stepped portion; and $L_2$ = the desired lifting amount through which the nozzle needle lifts for the initial injection.

* * * * *